United States Patent [19]

Hardey

[11] 3,971,432

[45] July 27, 1976

[54] DIE CASTING MACHINE

[76] Inventor: Donald Paul Hardey, 207 Sixth Ave., Sterling, Ill. 61081

[22] Filed: Jan. 17, 1975

[21] Appl. No.: 541,793

Related U.S. Application Data

[62] Division of Ser. No. 368,505, June 11, 1973, abandoned.

[52] U.S. Cl. ..... 164/318; 164/343; 425/247

[51] Int. Cl.[2] ..... B22D 17/04

[58] Field of Search ..... 164/113, 316, 318, 343; 425/244, 247, 251; 222/596

[56] References Cited

UNITED STATES PATENTS

| | | | |
|---|---|---|---|
| 1,002,325 | 9/1911 | Sigurdsson | 164/316 |
| 1,011,718 | 12/1911 | Barber | 164/316 |
| 3,433,292 | 3/1969 | McDonald | 164/343 |
| 3,547,184 | 12/1970 | Kock et al. | 164/343 |
| 3,596,708 | 8/1971 | Lapin | 164/343 |

*Primary Examiner*—Francis S. Husar
*Assistant Examiner*—John E. Roethel
*Attorney, Agent, or Firm*—Vincent L. Carney

[57] ABSTRACT

To move the die parts and cores into position for a casting operation, a plurality of pneumatic cylinders are mounted between two parallel plates of the head of a casting machine and arranged so that they each move a different one of a plurality of die parts and cores of a die from any of several angles, exerting primarily tension on the plates rather than torsion, with each cylinder including an internal locking mechanism having locking balls that drop into holding grooves to hold the piston of the hydraulic cylinder in position with sufficient strength to withstand the pressure of the molten metal applied to the die. To inject the molten metal into the die, a nozzle spool is moved in a straight line to communicate with the interior of the die between two die parts, the molten metal being fed to an annular recess around the spool by an injector and from the annular recess through openings in the spool into a central conduit that communicates with the interior of the die.

15 Claims, 6 Drawing Figures

FIG. 2
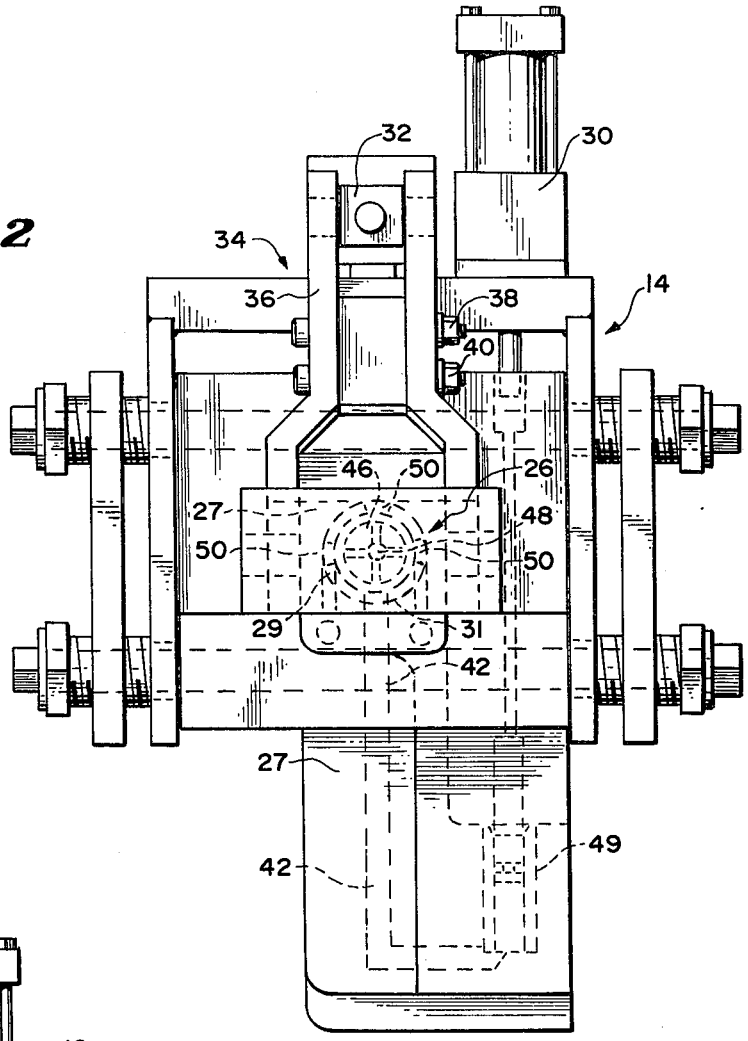
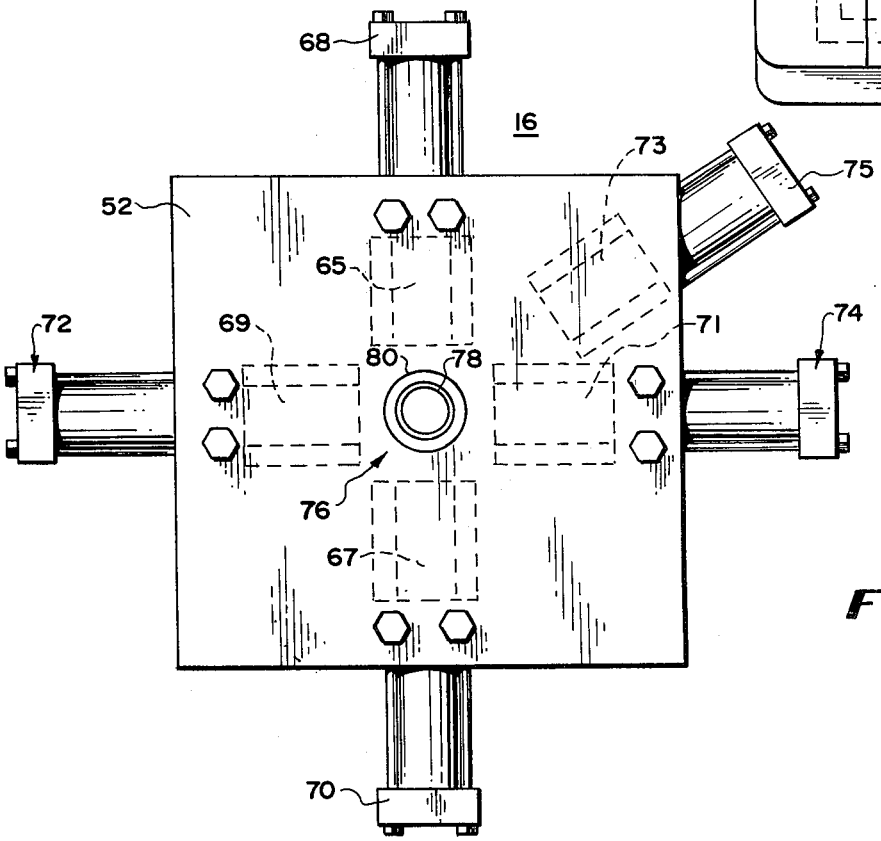
FIG. 3

DIE CASTING MACHINE

This is a division of application Ser. No. 368,505, filed June 11, 1973, now abandoned.

This invention relates to die casting machines,

One type of die casting machine includes as its principal parts a head for supporting the die parts during the casting operation, apparatus for moving the die parts and the cores together and apart, and a mechanism for injecting molten metal of unhardened plastic into the assembled die. The head includes a plate to which dies are mounted for guiding the die parts and cores, with pneumatic cylinders being mounted to the plate to move the die parts and the cores.

In one type of prior art die casting machine of this class, the head includes only a single plate to which a guide block is mounted having guideways through which the die parts and cores are moved, with two die parts being moved together in a first straight line and the cores being moved in a second line orthogonal to the first line to assemble the die.

This prior art head for supporting the die has the disadvantage of creating torsional forces in the plate when the die parts and the cores are held together. The torsional forces bend the plate, causing difficulty in properly aligning the die parts for the casting operation. Because of this difficulty, a rigid integrally-formed guide block is necessary to resist the torsion and resilient pressure pads must be provided within the guide block to bias the die parts into proper alignment when the support plate and rigid guide block bend under the torsion.

One prior art type of apparatus for moving and locking the die parts and cores together includes a different toggle mechanism connecting each part that is to be moved to a different pneumatic cylinder. The toggle mechanism aids in providing sufficient locking force to hold the die parts together when the molten metal or unhardened plastic is injected into the die.

This prior art apparatus for moving the die parts and cores together has the disadvantages of: (1) being relatively expensive and complicated; (2) limiting the number of parts that can be moved along the head of the die casting machine; and (3) limiting the direction in which the parts can be moved along the head.

One prior art type of mechanism for injecting molten metal or plastic into the die includes a gooseneck that is rocked into communication with the die while molten metal or unhardened plastic is pumped through the gooseneck into the die and then rocked free from the die. This prior art mechanism for injecting molten metal or unhardened plastic into the die has several disadvantages, which are: (1) the apparatus is relatively expensive; (2) the gooseneck must be rocked at an angle to the die and this creates problems in properly aligning the gooseneck for use with the die during the setup operation; (3) because the gooseneck is rocked at an angle to the die, it is subject to uneven wear and frequently needs repair; and (4) the rocking of the gooseneck tends to bend the head, thus aggravating the problem of aligning the die parts.

Accordingly, it is an object of the invention to provide an improved die casting machine.

It is a further object of the invention to provide an improved head for supporting the die in a die casting machine.

It is a further object of the invention to provide an improved support for a die in a die casting machine which support is not subject to heavy torsion.

It is a still further object of the invention to provide an improved mechanism for moving the die parts and cores in a die casting machine.

It is a still further object of the invention to provide a simple and inexpensive apparatus for moving the die parts or a core in a die casting machine.

It is a still further object of the invention to provide apparatus for moving die parts and cores, which apparatus may be adjusted to move the die parts or cores at different angles.

It is a still further object of the invention to provide apparatus for moving die parts and cores, which apparatus may be adjusted to move different numbers of die parts and cores without time-consuming modification of the machine.

It is a still further object of the invention to provide a novel pneumatic or hydraulic cylinder.

It is a still further object of the invention to provide a pneumatic or hydraulic cylinder which includes a simple and inexpensive locking mechanism for use in a die casting machine.

It is a still further object of the invention to provide a novel mechanism for injecting molten metal or unhardened plastic into a die.

It is a still further object of the invention to provide an apparatus for injecting molten metal or unhardened plastic into a die, which apparatus is relatively uncomplicated and inexpensive.

It is still further object of the invention to provide an apparatus for injecting molten metal or unhardened plastic into a die, which apparatus is easily aligned with the die.

It is a still further object of the invention to provide an apparatus for injecting molten metal or unhardened plastic into a die, which apparatus includes a part that moves in a straight line to communicate with the die.

It is a still further object of the invention to provide a nozzle spool for receiving molten metal or unhardened plastic along an annular recess in the nozzle spool and for applying the molten metal or unhardened plastic along an annular recess in the nozzle spool and for applying molten metal or unhardened plastic through an internal conduit in the spool into a die.

In accordance with the above and the further objects of the invention, a die casting machine is provided having an improved head, an improved apparatus for moving die parts and cores on the head and an improved apparatus for injecting molten metal or unhardened plastic into the die.

To move the die parts and cores along the head of the die casting machine, a different self-locking pneumatic cylinder is mounted to the head for each die part or core, with the piston rod of the cylinder directly moving the die parts or core in a guide. With this mechanism, a different number of die parts may be moved without time-consuming modification of the head by mounting an increased number of cylinders to the head. Moreover, the parts may be moved at any of a plurality of different angles with respect to each other without an extreme rearrangement of the head.

The self-locking cylinders include a plurality of locking balls which are moved into a locking groove when the piston of the cylinder is extended to hold the die parts together. Although this mechanism is simple and inexpensive, a strong locking force is applied to support the die parts when the molten metal or unhardened plastic is injected into the die.

To support the die parts and cores and the apparatus for moving them, the head includes two parallel plates with the pneumatic cylinders mounted between the plates. With this arrangement, the force applied to the plates is primarily tension. Because this force is tension rather than torsional, the plates do not bend and it is easier to align the parts of the die.

To inject the molten metal into the die, the metal is fed by pressure from the melting pot through a conduit and into an annular recess around the spool. An opening in the annular recess communicates with a conduit passing through the longitudinal axis of the spool. The spool has a polished front surface into which the conduit opens and is guided in a straight line to communicate with the die at a location where the two die parts meet to inject the molten metal into the die. With this mechanization, the gate is located at the dividing line of the casting where two die parts have come together and, thus if a sprue and flashing are present, they will be in the same place and can be removed during the machining operation normally performed to remove one of them.

The alignment problems with the spool are greatly simplified because it moves in a straight line and the pump communicates with the spool through a stationary conduit that communicates with the moving, wide annular recess around the circumference of the spool.

The die casting machine in accordance with this invention has several advantages such as: (1) the apparatus for injecting molten metal or unhardened plastic is inexpensive, reliable and easy to align because the spool moves in a straight line to engage the die, with the remainder of the apparatus through which the molten metal flows remaining stationary; (2) the alignment between die parts is easy to maintain despite wear from use of the parts because the force required to hold the parts together is primarily tension distributed between two supporting plates rather than torque applied to a single plate; (3) a large number of die parts may be moved together to form a multipart die; (4) the mechanism for moving the dies together and holding them in place is relatively simple and economical; and (5) a relatively large number of die parts may be combined to form the die.

The invention and the above and further features thereof will be better understood from the following detailed description when considered with reference to the accompanying drawings, in which:

FIG. 2 is an elevational view of an injector assembly forming part of the die casting machine of FIG. 1;

FIG. 3 is an elevational view of a head assembly included in the die casting machine of FIG. 1;

GENERAL DESCRIPTION

Figure 1:
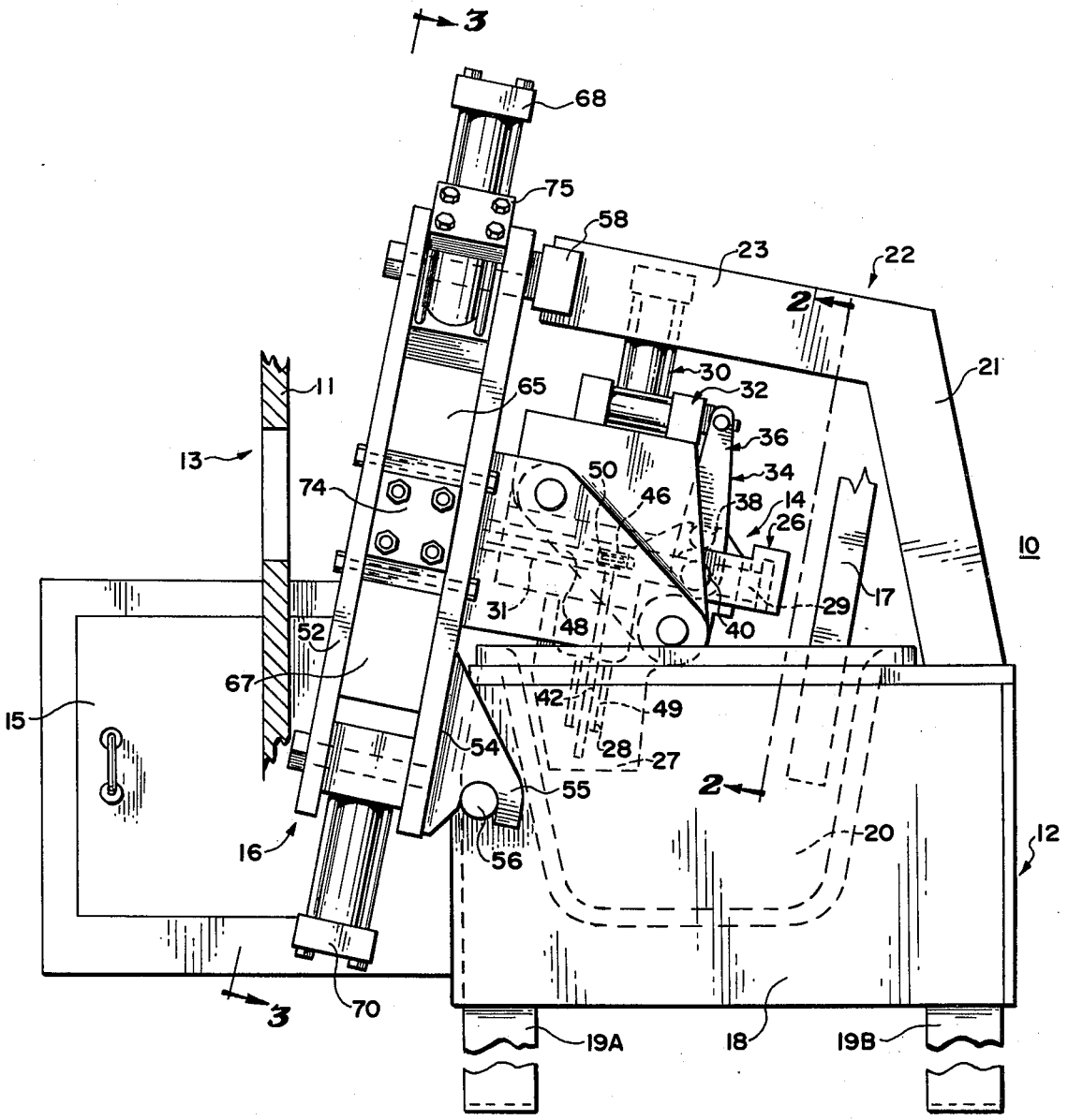
FIG. 1 is a fragmentary side elevational view of a die casting machine in accordance with an embodiment of the invention.

In FIG. 1, there is shown a die casting machine 10 having a frame assembly 12, an injector assembly 14, and a head assembly 16, with the injector assembly 14 and the head assembly 16 being supported by the frame assembly 12 in operable relationship to each other. The die casting machine 10 is shown cooperating with a casting receiver 13, which receives castings from the head assembly 16 of the casting machine 10, a control console 15 for controlling the operation of the casting machine 10 and apparatus 17 for supplying metal or plastic to the die casting machine 10, with the casting receiver 13, the control console 15 and the apparatus for supplying metal or plastic 17 being shown in fragmentary simplified views.

The frame assembly 12 includes a base portion 18, which is a hollow, right parallelepiped mounted upon four upstanding legs 19A–19D, with legs 19A and 19B being shown in FIG. 1. A melting pot 20 has a generally flat circular bottom connected to upwardly and outwardly extending walls with an outwardly-extending flange on their upper edges, which flange rests upon the top surface of the frame assembly 12, the main portion of the melting pot depending therefrom to contain molten metal or unhardened plastic to be used in die casting. The top frame 22, which serves as a hood as well as a supporting member includes a rear wall 21 including to parallel tubes extending upwardly from the rear end to which they are welded and slanting toward the front end of the frame 14 and a top frame 23 serving as a cover as well as a supporting member, including two tubes connected to the rear wall and extending forward thereof to overhang the melting pot 20.

INJECTOR ASSEMBLY

The injector assembly 14 shown in FIGS. 1 and 2 is bolted and supported by the head assembly 16. It includes a nozzle spool 29, a pump cylinder 30, an injector actuator cylinder 32, and a spool actuating assembly 34.

To receive molten metal or unhardened plastic for casting, the nozzle spool 29 communicates with an interior passageway 42 in a solid injection casting 27, which casting 27 depends downwardly into the melting pot to provide the nozzle spool with molten metal or unhardened plastic. The melting pot is pressurized by pump 49 which is driven by cylinder 30.

To move a portion of the nozzle spool 29 into communication with the interior of the die within the head 16, the spool actuating assembly 34 includes a coupling 26 into which the spool 29 fits, a lever 36, a first pin 38, and a second pin 40. The piston rod of the pneumatic cylinder 32 is pinned to the lever 36 of the nozzle spool 29, with the lever 36 pivoting about the pin 38 as the piston of the pneumatic cylinder 32 extends to the right (FIG. 1) so that the pin 40, which engages the coupling 26, is moved to the left, moving the coupling 26 and the spool 29 into the head 16 where it communicates with the die mounted thereon.

To enable the molten metal or unhardened plastic to flow through a conduit in the nozzle spool 29 (which maybe considered as a first conduit) from an inlet of the conduit and out of the conduit outlet and then into the die, the nozzle spool 29 fits within a bore 31 in a solid casting 27, the spool 29 having a shoulder on one end resting within the coupling 26 for longitudinal movement so that the spool 29 moves within the bore 31. The spool 29 includes an annular recess 46 circumscribing the spool near its center portion and a conduit 48 along the longitudinal axis of the spool 29, having one end opening from the left end (FIG. 1) of the spool 29 to communicate with the die and the other end communicating with the annular groove 46 through 4 radially extending slots 50, with each of the slots 50 being located 90° from each of its adjacent slots along the circumference of the recess 46 and intercepting the conduit 48 from locations 90° removed along the conduit 48.

To supply molten metal or unhardened plastic to the spool 29, the injector casting 27 includes a conduit 42 (which may be considered as a second conduit) aligned with the annular recess 46 and extending into the bore 31 so that molten metal applied to the conduit 42 is an inlet port of the conduit 42 is contained within the recess 46 by the casting 27 which serves as a closure, while it is permitted to flow from an exit port into the conduit 48 through the slot 50, with the annular recess 46 being sufficiently wide and being positioned so that the conduit 42 remains aligned with it as the spool 29 moves into and out of communication with the die. The pump 49 pumps molten metal or unhardened plastic from the melting pot 20 into the conduit 42.

The pump 49, melting pot 20 and injector casting 27 may be any suitable apparatus for supplying molten metal or unhardened plastic to the nozzle spool 29, many types of which are known in the prior art.

While a spool 29 having an annular recess 46 closed by the injector casting 27 has been described in the preferred embodiment, obviously other structures may be used for the nozzle. For example, the conduit 42 could extend over the top of the spool and the recess could be applied only through the top side of the spool rather than through the annular groove. Moreover, the spool need not be cylindrical but may be of virtually any other shape that permits a suitable communication with the die.

HEAD ASSEMBLY

The head assembly 16 includes two parallel metal plates 52 and 54, each being positioned at a 10° angle with the front side of the base 12 with the plate 54 abutting and being fastened to the injector assembly 14 and the plate 52 being spaced a short distance outwardly from the plate 54.

To mount the head assembly 16 to the frame assembly 18 of the casting machine 10, the plate 54 includes at its lower end a bracket 55 having an opening that engages a pin 56 and at its upper end a bracket 58 which is bolted to the structural members of the cover 23 of the hood 22, with the plate 52 being bolted to the plate 54.

Between the plates 52 and 54, two pneumatic cylinders 68 and 70 are mounted to move toward and away from each other with the center of movement being in a line extending through the longitudinal axis of the nozzle spool 29. Inwardly of the pneumatic cylinders between the plates 52 and 54, the movable parts 65 and 67 of the dies are each mounted by different crossheads to the moving parts of the pneumatic cylinders 68 and 70 to move therewith so that when the pistons of the hydraulic cylinders 68 and 70 are fully extended, the two die parts 65 and 67 are together with the end of the spool 29 passing through an opening in the inner plate 54 to communicate with the interior of the die.

In FIG. 3, there is shown an elevational view of the head assembly 16 showing the relative locations of the front plate 52, the rear plate 54 (FIG. 1) five pneumatic cylinders 68, 70, 72, 74 and 75 and a centrally located injection section 76. The injection section includes a centrally located, circular, injection aperture 78 to permit molten metal or unhardened plastic to pass through the rear plate 54 and a larger generally circular casting-ejection aperture 80 in the front plate 52, with five die parts 65, 67, 69, 71 and 73 mounted in separate guides between the front and rear plates at spaced-apart locations around the injection aperture and in line with the pneumatic cylinders 68, 70, 72, 74, and 75 so that the piston rods of the pneumatic cylinders each move a different die part or core through a different one of the guides into engagement adjacent to the injection aperture to form an assembled die that receives molten metal from the spool 29.

In actual practice, a cooling system of any type known in the art is also included in the head assembly but is not shown in FIG. 3 for the purpose of simplifying this figure. Moreover, many different types of die parts, cores and die mountings may be provided and may be mounted to different types of guides at different angles around the injection aperture 78.

OPERATION

Before operating the die casting machine 10, appropriate die parts 65, 67, 69, 71 and 73 are mounted to the guides in the head 16. Although two movable die parts 65 and 67 are shown in FIG. 1 and five in FIG. 3 for illustrative purposes, any number of die parts may be utilized, with each die part generally being moved by a hydraulic cylinder. Cores are also moved by similar cylinders within guides at an angle to the cavities so as to assemble a complete multi-part die at the center of the head 16.

With the die parts mounted in place, molten metal or unhardened plastic is prepared in the melting pot 20 to be ready to inject into the die. An appropriate operating program is also set up in the control console 15. Both the melting pot and the control console 15 are of conventional design, with the melting pot 20 being supplied with new metal through the apparatus 17 in a manner known in the art.

In operation, the die parts are moved together by their respective pneumatic cylinders. The cylinders are of a type which move the die parts together and hold them with relatively strong locking force as will be described more fully hereinafter.

With the die parts moved together, the pneumatic cylinder 32 is extended, causing its piston to pivot the lever 36 about the pivot pin 38 in a clockwise direction to move the nozzle spool 29 to the left (FIG. 1) so that it communicates with the interior of the die. With the die and spool in position, molten metal or unhardened plastic is pumped through the conduit 42 around the annular recess 46 through the slots 50 and through the conduit 48 within the spool 29 into the die.

When the die has received the molten metal or unhardened plastic and a time period elapses to chill the metal or plastic, the pump plunger retracts to depressurize the metal and refill the pump cylinder and the piston of the pneumatic cylinder 32 is retracted causing the lever 36 of the spool actuating mechanism 34 to pivot about the pin 38 in a counter-clockwise direction, retracting the spool 29 from the die.

The die casting machine shown in FIG. 1 has several advantages such as: (1) the injection assembly is inexpensive, reliable and easy to align because the spool 29 moves in a straight line and the spool 29 and spool actuating assembly 34 are the only moving parts, with the injector casting 27 remaining stationary; (2) the alignment between die parts is easy to maintain despite wear from use of the parts because the force required to hold the parts together is mainly tension distributed between the two plates 52 and 54 rather than torque applied to a single plate which would cause misalignment of separate die parts; (3) a plurality of die parts may be moved together from different angles to form a multipart die; (4) the mechanism for moving the dies together and holding them in place is relative simple and economical; and (5) a relatively large number of die parts may be combined to form a die.

While pneumatic cylinders have been referred to in the above description, it is understood that the system may be hydraulic as well since the principles are common to any fluid operated system.

SELF-LOCKING PNEUMATIC CYLINDERS

Figure 4:
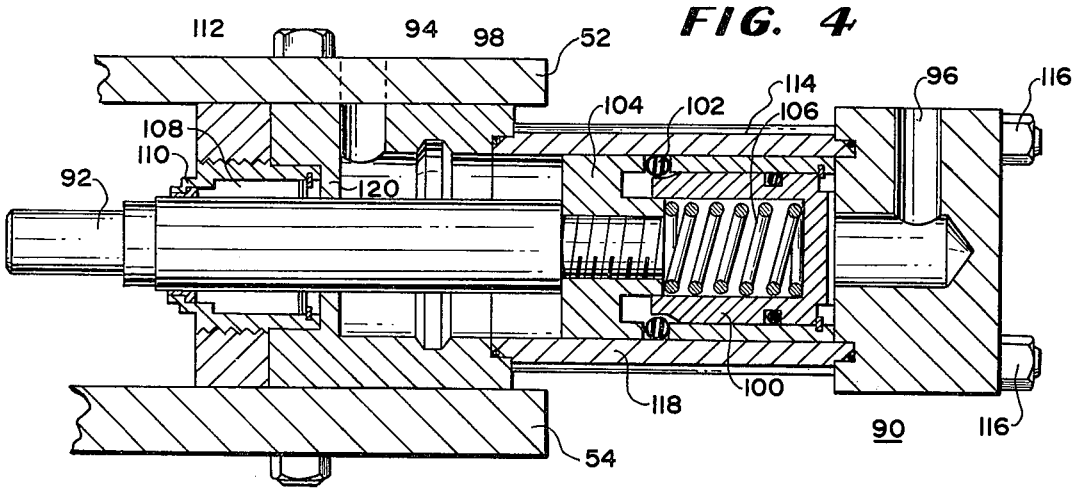
FIG. 4 is a longitudinal sectional view of an embodiment of pneumatic cylinder included in the die casting machine of FIG. 1, with its piston in a retracted position.

In FIG. 4, there is shown one embodiment 90 of self-locking fluid-operated cylinder mounted between the plates 52 and 54 of the head assembly suitable for use as the pneumatic cylinders that actuate the die parts and cores such as the cylinders 68, 70, 72, 74 and 75. The cylinder 90 includes a piston rod 92, a head port 94, a cap port 96, a locking groove 98, a secondary piston 100, a plurality of locking balls 102, a primary piston 104 and a preload spring 106.

The piston rod 92 is mounted in the head section of the cylinder and surrounded by piston rod packing 108 which is held in place by piston packing cartridge 110 and a packing retainer plate 112 within the head. The head and cap are held together over the cylinder barrel 118 by tie rods 114 and tie rod nuts 116.

To move the piston rod 92 between its extended and retracted positions, the primary piston 104 is a cylindrical tube positioned to reciprocate within the cylinder barrel 118. On one end of the primary cylinder 104, one face engages a shoulder of the piston rod 92 and a central taped hole threadedly receives a cylindrical portion of the piston rod 92 to move the piston rod 92 therewith. The other end of the primary piston 104 is open and receives the open end of the tubular secondary piston 100, with the preload spring 106 fitting therebetween so that the primary and secondary pistons move with respect to each other in response to fluid pressure and the preload spring 106.

To control the position of the primary and secondary pistons 104 and 100, the head port 94 communicates with one side of the primary and secondary pistons 104 and 100 and the cap port 94 communicates with the opposite end of the primary and secondary pistons so that fluid flowing into the cap port 96 and from the head port 94 moves the pistons into an extended position and fluid flowing into the head port 94 and out of the cap port 96 moves the pistons and piston rods into their retracted position shown in FIG. 3.

To lock and unlock the primary and secondary pistons 104 and 100, the locking ball groove 98 is an annular groove around the interior wall of the cylinder near its forward end circumscribing the piston rod 92 and is of sufficient size to receive a plurality of locking balls 102 that are held within the primary piston 104.

To move the locking balls to and from the locking ball groove, a ring of circumferentially spaced-apart holes within the outer wall of the primary piston 104 receives the locking balls 102 and carries the locking balls therewith in reciprocating motion within the barrel 118. The secondary piston 100 fits within the primary piston 102 and is adapted to reciprocate therein against the pressure of the preload spring 106. One end of the secondary piston 100 facing the interior of the primary piston 104 is chamfered to fit over the locking balls 102 while they are within the holes in the primary piston 104. This end of the secondary piston 102 fits within the pimary piston 104 with the chamfered end of the secondary piston 100 moving beyond the holes holding the balls 102 so that the cylindrical surface pushed the balls 102 within the locking ball groove 98 when the primary and secondary pistons 104 and 108 are both moved to their most forward position by the fluid pressure applied to the port 96.

The preload spring 106 is sufficiently strong to push the secondary piston 100 back out of the primary piston 104 a sufficient distance to bring the chamfered end of the secondary piston 100 over the locking ball groove 98 when the fluid pressure applied to port 96 is reduced so that the locking balls 102 may be moved from the locking ball groove 98 when the fluid pressure in the cap port 94 moves the pistons toward their retracted position.

In operation, the pneumatic cylinder 90 is moved from its retracted position shown in FIG. 3 to its extended and locked position shown in FIG. 4 and returned to its retracted position shown in FIG. 3 by fluid pressure applied to the ports 94 and 96.

Figure 5:
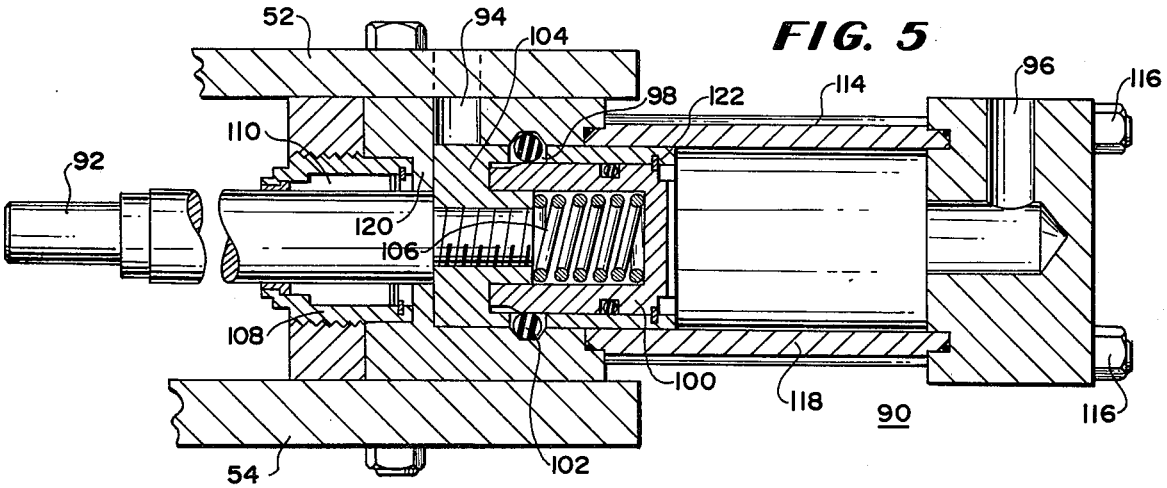
FIG. 5 is a longitudinal sectional view of the cylinder shown in FIG. 1 with its piston rod in an extended position.

To move the piston from its retracted position shown in FIG. 4 to its extended and locked position shown in FIG. 5, fluid is applied to the cap port 96 and the head port 94 is drained. The fluid exerts pressure on the secondary piston 100, which in turn, forces the primary piston 104 to the left (FIGS. 4 and 5) by pressing against it through the preload spring 106). The primary piston 104, as it moves to the left, moves the piston rod 92 with it by pressing against the shoulder thereof.

Of course, the load applied to the piston rod 92 cannot be so great that the pressure differential between the secondary piston 100 and the piston rod 92 exerted by the fluid exceeds the strength of the spring 106 or the spring 106 will tend to compress so as to permit the chamfered end of the secondary piston 100 to exert pressure on the locking balls 102 thus forcing them into the barrel 118 and possibly damaging this barrel as well as tending to lock the pistons in place.

When the piston rod 92 is fully extended, the primary piston 104 abuts against the inner shoulder 120 of the cap. At this time, the fluid pressure causes the secondary piston 100 to move into the primary piston 104 by compressing the spring 106. When the primary piston 104 abuts the shoulder 120, the holes holding the locking balls 102 are aligned with the locking ball groove 98 so that the locking balls are forced therein. As a secondary piston 100 moves into the primary piston 104, the balls are pushed further within the annular groove 98 and held in place by the outer cylindrical surface of the secondary piston 100 as shown in FIG. 5. In this position, the piston rod 92 and the primary piston 104 are locked in the extended position by the locking balls 102 which are within the locking ball groove 98.

To move the pneumatic cylinder 90 from its extended and locked position shown in FIG. 5 into its retracted position shown in FIG. 4, fluid is applied to the head port 94 and drained from the cap port 96. This fluid exerts pressure on the secondary piston 100, moving it to the right (FIGS. 4 and 5), thus enabling the locking balls 102 to move out of the annular locking groove 98. When the locking balls 102 have moved from the locking groove 98, the primary piston 104 is moved to the right by the fluid pressure and by pressure exerted by the secondary piston 100 against the snap ring 122 which abuts the right shoulder of the secondary piston 100 and is held within a groove in the inner of the primary piston 104. As the primary piston 104 moves to the right it pulls the piston 92 to the right, since it is threaded to the shank.

Figure 6:
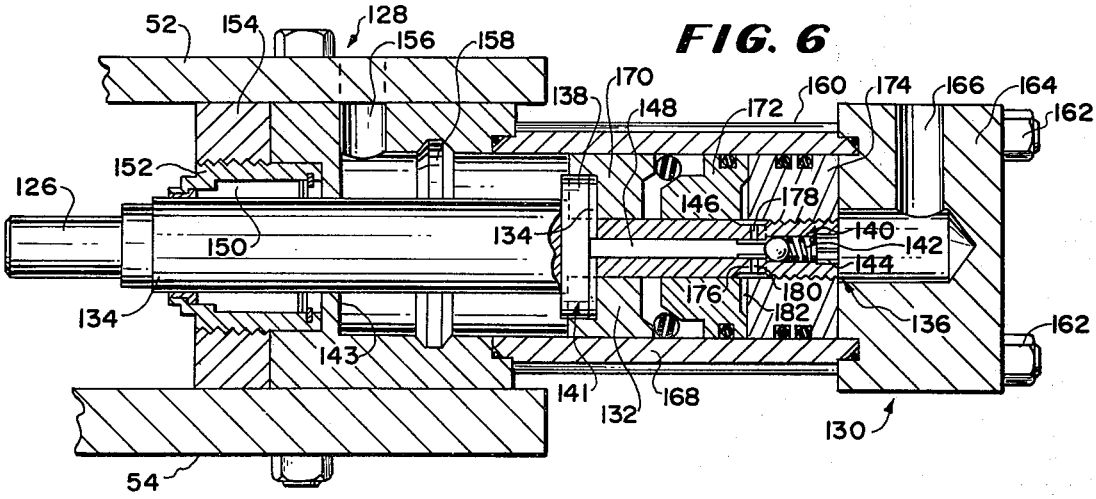
FIG. 6 is a longitudinal sectional view of another embodiment of pneumatic cylinder which may be used with or instead of the cylinder shown in FIGS. 4 and 5 in the die casting machine of FIG. 1.

In FIG. 6, there is shown another embodiment of pneumatic cylinder 124 which may serve as a substitute for the pneumatic cylinder 90 shown in FIGS. 4 and 5. The pneumatic cylinder 124 is similar to the pneumatic cylinder 90 but is capable of exerting a greater pressure because it is not limited by the maximum rated strength of the preload spring.

The pneumatic cylinder 124 includes a piston rod 126, a head section 128, a cap section 130, and a control section 132.

The head section 128 of the pneumatic cylinder 124 includes packing 150 about the piston portion 134 of the piston rod 126, a packing cartridge 152, and retainer plate 154. The cap portion of the pneumatic cylinder 124 includes tie rods 160, tie rod nuts 162, a cylinder cap 164, and a cylinder barrel 168.

The control section 132 includes a forward piston 170, a camming ring 172, a rear piston 174, a head port 156, a locking ball groove 158, a cap port 166 and a plurality of locking balls 176.

To move the piston rod 126 between its extended position and its retracted position, the forward piston 170 and the rear piston 174 circumscribe the piston rod, having a tight fit for motion therewith, with a cylindrical sleeve fitting between them around the piston rod 126.

The head port 156 communicates with the cap port 166 through the interior of the pneumatic cylinder 124 so that when fluid is applied to the cap port 166 and drained from the head port 156, the piston rod 126, the forward piston 170, and the rear piston 174 are moved to the extended position and when the fluid pressure is applied to the head port 156 and drained from the cap port 166, the piston rod 126, the forward piston 170 and the rear piston 174 are moved to the retracted position.

To lock the piston rod 176 in its extended position, the locking ball groove 158 is an annular groove in the inner wall of the head block of the hydraulic cylinder near the head port 156 having slanted sides and being of such a size as to receive the locking balls 176 so that a portion of the locking balls will extend therefrom to hold the forward piston 170 and the piston rod 126 from movement into their retracted position.

To move the locking balls 176 to the locking groove 158, to hold them in position, to remove them during an unlocking operation, and to move them back to a retracted position, the locking balls 176 and the camming ring 172 are contained in a compartment between the rear surface of the forward piston 170, the front surface of the rear piston 174, the outer surface of the sleeve between the forward piston and the rear piston, and the barrel wall. The camming ring 172 has a cylindrical inner bore circumscribing the elongated cylindrical portion of the sleeve so that it is free to move forward and backward between the rear shoulder of the forward piston 170 and the radially, outwardly extending portion of the rear piston 174.

The camming ring 172 includes a forward beveled annular surface which slants upward from the barrel walls over the locking balls 176 to force the locking balls 176 down into the locking ball groove 158 during forward motion of the camming ring and to hold them against the cylindrical surface. A shoulder on the forward piston 170 pushes the locking balls 176 from the locking ball groove 158 over the slanted surface thereof when the camming ring 172 is in its rearmost position and the piston rod 126 and the forward and rear pistons 170 and 174 are moving into their retracted position.

To permit the flow of fluid to move the camming ring into locking position and to retract it therefrom, a relief section is provided between the rear piston 174 and the sleeve and the cam 172 that rides on the sleeve, which relief section includes radially-extending relief portions 180 and 182 adjacent to the rear piston 174 to permit the flow of fluid through apertures in the piston 126 to be described hereinafter so as to move the camming ring 172 into its forward locking position and back into its rear unlocking position. The piston rod 126 includes a cylindrical elongated piston portion 134 and an apertured valve portion 136, with the apertured valve portion including a relief portion in the form of an annular recess 182 communicating with diametrically transverse slots 178 extending through the valve inlet to permit air to flow through the valve when the valve element 146 is removed therefrom and into position beneath the rear piston so as to permit air to flow through the relief portion 182 to move the cam ring 172.

To control the flow of fluid through the control section, the aperture valve portion includes a transverse slot 134 containing an actuator bar 141 extending beyond the lateral sides of the piston rod 134 in a direction transverse to the longitudinal axis of the piston rod and fitting loosely within the slot to provide one-quarter of an inch of movement within the slot 134 in the direction of the longitudinal axis of the piston rod.

At the cap end of the valve portion of the piston rod, there is a valve chamber 140 extending along the longitudinal axis of the piston rod and containing a helical compression spring 142 which exerts pressure between an apertured plug 144 flush with the end of the piston rod on a ball valve element 146, with the ball valve element 146 closing a valve seat. An elongated valve opening extending along the longitudinal axis of the piston rod communicates with the slot 134 at one end and with the valve seat at the other end, with an elongated actuator rod 148 fitting within the valve opening and extending one-quarter of an inch into the slot 134 at one end when its other end is abutting the ball valve element 146.

In operation, fluid is applied to the cap port 166 and drained from the nead port 156 to cause the piston rod 126 to be extended and locked in place with the locking balls 176 being within the locking groove 158 and fluid is applied to the head port 156 and drained from the cap port 166 to unlock the piston rod 126 and move it into its retracted position.

To extend the piston rod 126, the fluid flowing into the cap port 166 exerts pressure on the rear cylinder 174 and the fluid control portion 136 of the piston rod 126, with the valve 140 being closed. The fluid pressure forces the piston 126 into its extended position with the piston rod moving outwardly until the actuator bar 141 contacts the shoulder of the cylinder head and the rear side of the actuator slot 132 contacts the actuator bar to stop the piston.

To lock the piston rod 126 in place, the actuator rod 148 is pushed rearwardly by the actuator bar 141 when the actuator bar 141 strikes the shoulder 143 and is forced against the backside of the actuator slot 138. The actuator rod 148 moves the valve element ball 146 from the valve seat to permit fluid to flow through the valve, the transverse slots 178, the relief section 176, the slot 180 into the relief portion 182. The fluid in the relief portions 182 forces the cam ring forward so that it cams the locking balls 176 into the locking ball groove 158 and moves over the balls to hold them in place so that the cam ring cannot be pushed back.

To unlock and move the piston rod 126 into its retracted position, the fluid flowing into the head port 156 moves the camming ring 172 rearwardly permitting the locking balls 176 to be forced up the camming sides of the locking ball groove 158, thus unlocking the piston rod 126. The fluid then moves the piston control section and piston rod 126 back into its retracted position shown in FIG. 6.

The fluid-operated pistons shown in FIGS. 4–6 have the advantage of enabling the die parts and cores to be moved into the assembled positions, locked in place in this position while the metal is injected into the die, and retracted without requiring a large number of parts. They provide positive locking which is sufficient to withstand the pressure of the molten metal applied to the die and are sufficiently small in six to enable a large number of die parts and cores to be utilized, with the locking force being equal to the combined shear strength of the locking balls or the bournelling of the locking groove.

The embodiment of hydraulic piston shown in FIG. 6 has the further advantages of: (1) having a simpler design and being less expensive to manufacture; (2) having a greater lock-load capacity resulting from a large number of locking balls for any given cylindrical diameter; (3) having a longer life exepectancy because the balls are permitted to float in the assembly during motion; (4) providing fail-safe locking and preventing any possibility of internal damage by hydromechanically sequencing the cam ring; and (5) not being limited in its load force by the strength of the preload spring.

Although a preferred embodiment has been described with some particularity, many modifications and variations of the preferred embodiment are possible without deviating from the invention. Accordingly, it is to be understood that, within the scope of the appended claims, the invention may be practiced other than is specifically described.

What is claimed is:

1. Die casting apparatus for applying a molding material to a die comprising:
- a first conduit having an inlet and an outlet;
- means for moving said first conduit to bring said outlet in communication with a die;
- a second conduit having first and second ports with said first port being adapted to receive said molding material from a source of molding material;
- said second port communicating with said inlet; and
- means for maintaining said second port in communication with said inlet to apply said molding material to said first conduit while said first conduit is moving and said second port is stationary.

2. Apparatus according to claim 1 in which said means for moving includes guide means for moving said first conduit axially along a substantially straight path.

3. Apparatus according to claim 1 in which said inlet is sufficiently wide and positioned so that said exit port remains aligned with it as said first conduit means is moved and said apparatus further includes a closure means through which said second conduit extends; said closure means covering said inlet except for said second conduit, whereby said inlet moves with respect to said second port as said first conduit moves, with said closure means closing different portions of said inlet as said first conduit moves.

4. Apparatus according to claim 1 in which said first conduit comprises a cylinder; said outlet being an opening in one end of said cylinder; said inlet including an annular recess around said cylinder, said cylinder including an opening extending from the outlet to the inlet, and communicating with said cylindrical recess through at least one slot; said second port communicating with said recess.

5. An apparatus for applying a molding material to a die according to claim 1, comprising:
- means for mounting die parts;
- said means for mounting comprising a first plate and a second plate;
- said first and second plates being mounted parallel to each other;
- at least one fluid-operated cylinder being mounted between said first and second plates adapted to move said die parts;
- said means for moving said first conduit to bring said outlet in communication with a die including means for moving said first conduit to bring said outlet in communication with at least two of said die parts, whereby said molding material may be applied to a die comprised of said die parts.

6. Apparatus according to claim 5 including at least two fluid-operated cylinders mounted at an angle to each other that is less than 90°.

7. Apparatus according to claim 5 in which at least five fluid-operated cylinders are mounted between said plates, each being adapted to move a different die part.

8. Apparatus according to claim 7 further comprising:
- a plurality of die guides;
- a different one of said plurality of die guides being aligned with each of said cylinders, whereby said cylinders may move a die through said die guides.

9. Apparatus according to claim 8 in which each of said fluid-operated cylinders includes a different piston rod and a different die part is mounted directly to each of said piston rods.

10. Apparatus according to claim 9 in which at least some of said fluid-operated cylinders are self-locking cylinders.

11. Apparatus according to claim 10 further comprising:
- a control unit for controlling the operation of the die casting machine;
- means for holding said moldable material;

means for pumping said moldable material to said apparatus for applying the moldable material to a die; and means for applying the moldable material to said means for holding.

12. Apparatus for applying a molding material to a die according to claim 1, comprising:

support means for supporting a plurality of die parts;

said support means including at least two parallel plates;

means for mounting at least one fluid-operated cylinder between said parallel plates;

said die parts, when assembled, comprising said die;

said means for moving said first conduit including a means for moving said first conduit to bring said outlet in communication with at least two of said die parts, whereby said molding material may be inserted into said die.

13. Apparatus according to claim 12 in which at least five fluid-operated cylinders are mounted between said parallel plates.

14. Apparatus according to claim 13 further including at least five guides each positioned in line between a first location and a different one of said cylinders.

15. Apparatus according to claim 14 in which said fluid-operated cylinders are self-locking cylinders.

* * * * *